US008109771B2

(12) United States Patent
Chen

(10) Patent No.: US 8,109,771 B2
(45) Date of Patent: Feb. 7, 2012

(54) ELECTRICAL CONNECTOR WITH IMPROVED CONTACTS

(75) Inventor: Ming-Ching Chen, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/795,675

(22) Filed: Jun. 8, 2010

(65) Prior Publication Data

US 2010/0311256 A1 Dec. 9, 2010

(30) Foreign Application Priority Data

Jun. 8, 2009 (TW) ..... 98210119

(51) Int. Cl.
*H01R 12/00* (2006.01)

(52) U.S. Cl. ..... 439/74

(58) Field of Classification Search ..... 439/74, 439/660, 71
See application file for complete search history.

(56) References Cited

U.S. PATENT DOCUMENTS

| | | | | |
|---|---|---|---|---|
| 5,885,092 | A * | 3/1999 | Ito et al. | 439/74 |
| 7,410,364 | B2 * | 8/2008 | Kishi et al. | 439/74 |
| 2004/0171285 | A1 * | 9/2004 | Okura | 439/74 |
| 2009/0029572 | A1 * | 1/2009 | Midorikawa | 439/74 |

* cited by examiner

*Primary Examiner* — Phuong Dinh
(74) *Attorney, Agent, or Firm* — Wei Te Chung; Andrew C. Cheng; Ming Chieh Chang

(57) ABSTRACT

An electrical connector includes an insulative housing defining a receiving room having a bottom wall and a mating portion extending upward from an inner face of the bottom wall of the receiving room and a plurality of contacts received in the housing. The mating portion has a plurality of receiving passageways communicating with the receiving room and a plurality of nose portions are above the receiving passageways. Each contact defines an elastic portion, a soldering portion, and a fixing portion between the elastic portion and a soldering portion. The elastic portion includes a first contacting portion protruding from the nose portion in the receiving room, a second contacting portion extending from the fixing portion, and a connecting portion between two contacting portions and defining an arc portion extending in an upward-to-downward direction and under the nose portion. The arc portion defines a node extending far from the nose portion.

16 Claims, 5 Drawing Sheets

(a)

(b)

(c)

ELECTRICAL CONNECTOR WITH IMPROVED CONTACTS

BACKGROUND OF THE INVENTION

1. Field of the Invention

The present invention relates to an electrical connector, and more particularly to an electrical connector with improved contacts which are assembled from a mating face of the electrical connector.

2. Description of the Related Art

U.S. Pat. No. 7,410,364 issued to Masanori Kishi on Aug. 12, 2008 discloses a conventional board-to-board connector. The board-to-board connector includes an insulative housing and a plurality of contacts assembled in the housing. Each contact defines a contacting portion located in a terminal receiving cavity of the housing and connecting with a contact of a mating electrical connector. The housing defines a plurality of nose portions above the terminal receiving cavities to prevent the contacts out of the housing due to a mating force between the board-to-board connector and the mating electrical connector. The contacts are inserted in the housing from opens of a bottom wall of the housing because of the stopping of the nose portions. Soldering portions of the contacts are soldered to a PCB (Print Circuit Board) and coated with a protective solute for soldering. The protective solute might flow into the housing from the opens.

In view of the above, a new electrical connector that overcomes the above-mentioned disadvantages is desired.

SUMMARY OF THE INVENTION

Accordingly, an object of the present invention is to provide an electrical connector with improved contacts which are assembled from a mating face of the electrical connector.

To fulfill the above-mentioned object, an electrical connector comprises an insulative housing defining a receiving room having a bottom wall and a mating portion extending upward from an inner face of the bottom wall of the receiving room and a plurality of contacts received in the housing. The mating portion has a plurality of receiving passageways communicating with the receiving room and a plurality of nose portions are above the receiving passageways. Each contact defines an elastic portion, a soldering portion, and a fixing portion between the elastic portion and a soldering portion. The elastic portion includes a first contacting portion protruding from the nose portion in the receiving room, a second contacting portion extending from the fixing portion, and a connecting portion between two contacting portions and defining an arc portion extending in an upward-to-downward direction and under the nose portion. The arc portion defines a node extending far from the nose portion.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Referring to FIGS. 1-4, an electrical connector 100 welding to a PCB (not shown) includes an insulative housing 1 and a plurality of contacts 2 assembled in the housing 1 wherein only one pair of contacts are illustrated in drawings for simplicity and others are omitted.

Figure 1:
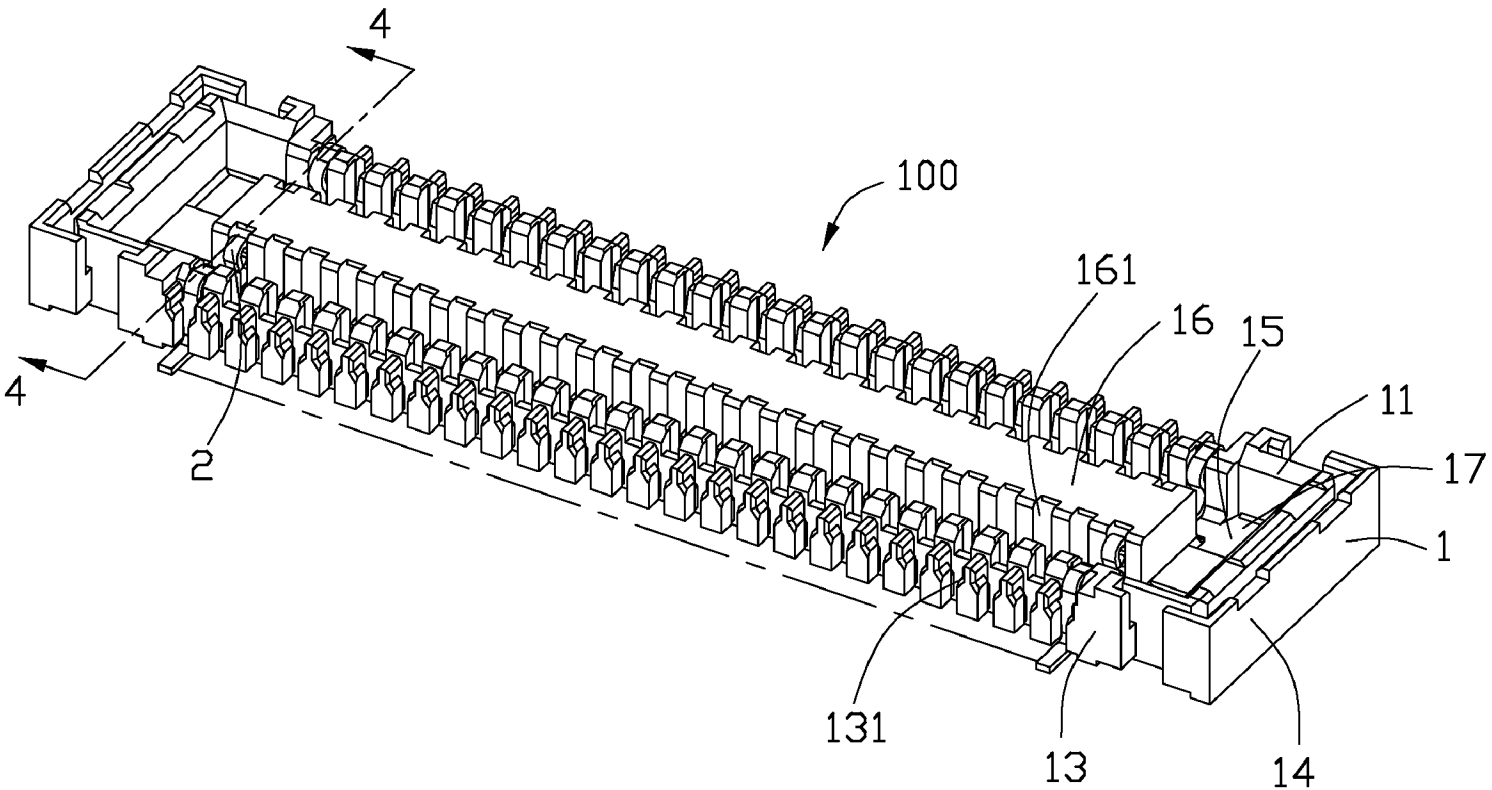
FIG. 1 is a top perspective view of an electrical connector of the present invention.
Figure 2:
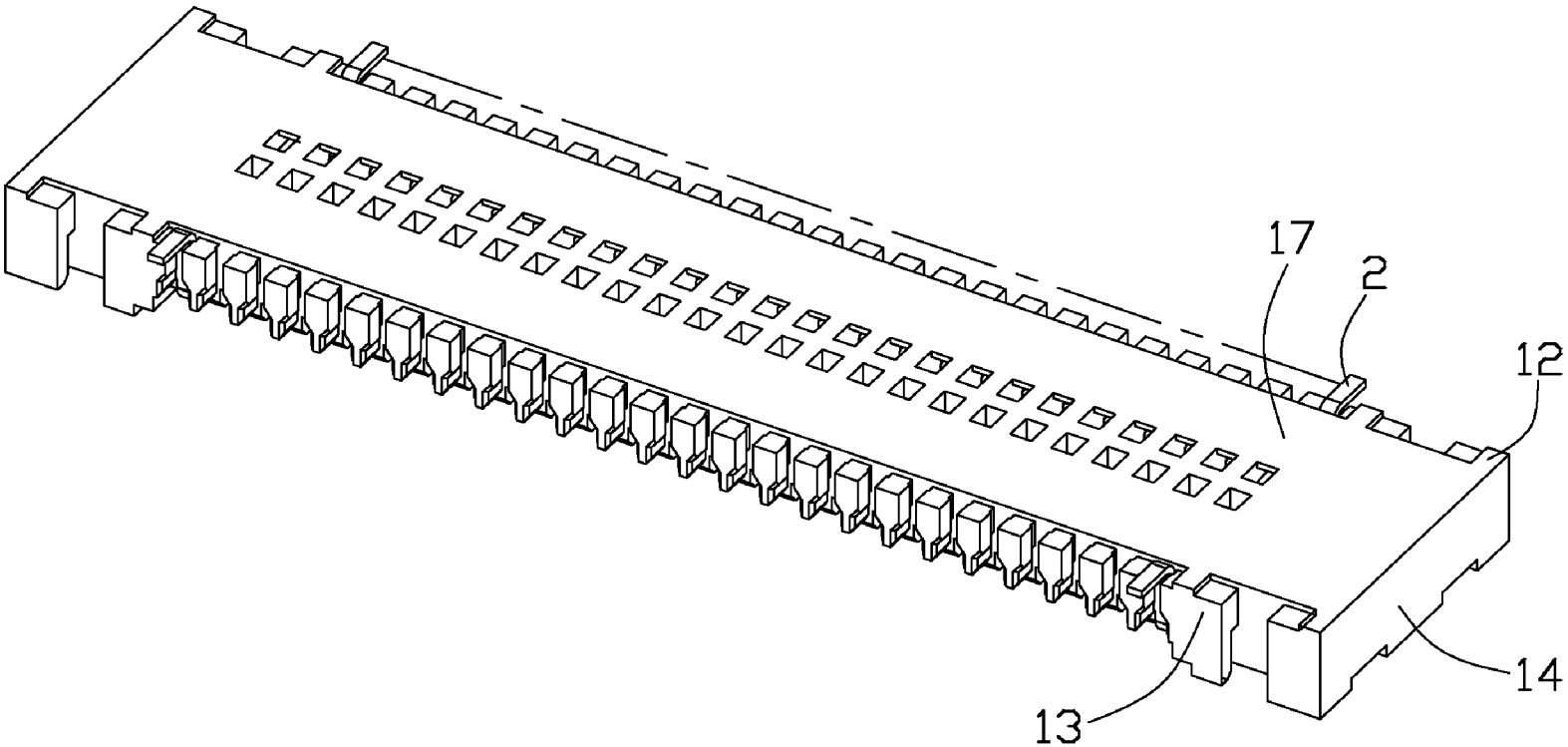
FIG. 2 is a bottom perspective view of the electrical connector.

Referring to FIGS. 1-2, the housing 1 having an elongate configuration with a mating interface defines an upward mating face 11 and a mounting face 12 opposite to the mating face 11. The housing 1 includes a pair of lengthwise sidewalls 13 and a pair of widthwise sidewalls 14 bridging the two lengthwise sidewalls 13. The sidewalls 13, 14 and a bottom wall 17 jointly define a receiving room 15 thereamong. A mating portion 16 extends upward from an inner face of the bottom wall 17 and is located at a center of the receiving room 15 along the lengthwise direction. The mating portion 16 is configured with a rectangle manner parallel to the sidewalls, and defines a plurality of receiving passageways 161 across the housing 1 and symmetrically arranged along the mating portion 16. A plurality of retaining passageways 131 for further retaining the contacts 2 are formed on outside faces of the lengthwise sidewalls 13, which connect with receiving passageways 161.

Figure 3:
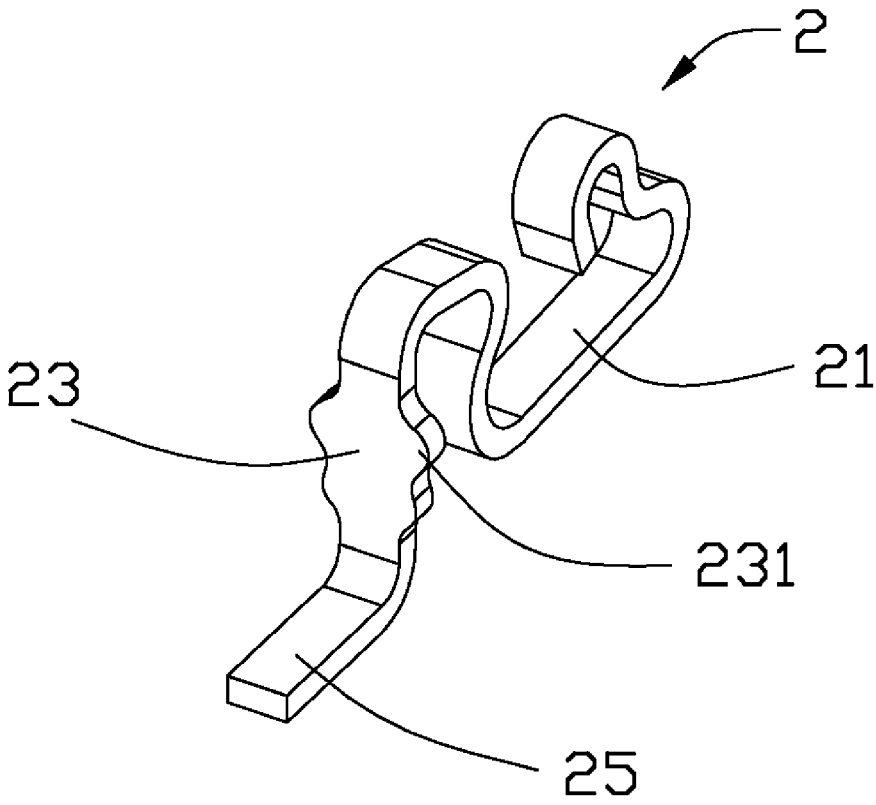
FIG. 3 is a perspective view of a contact of the electrical connector.
Figure 4:
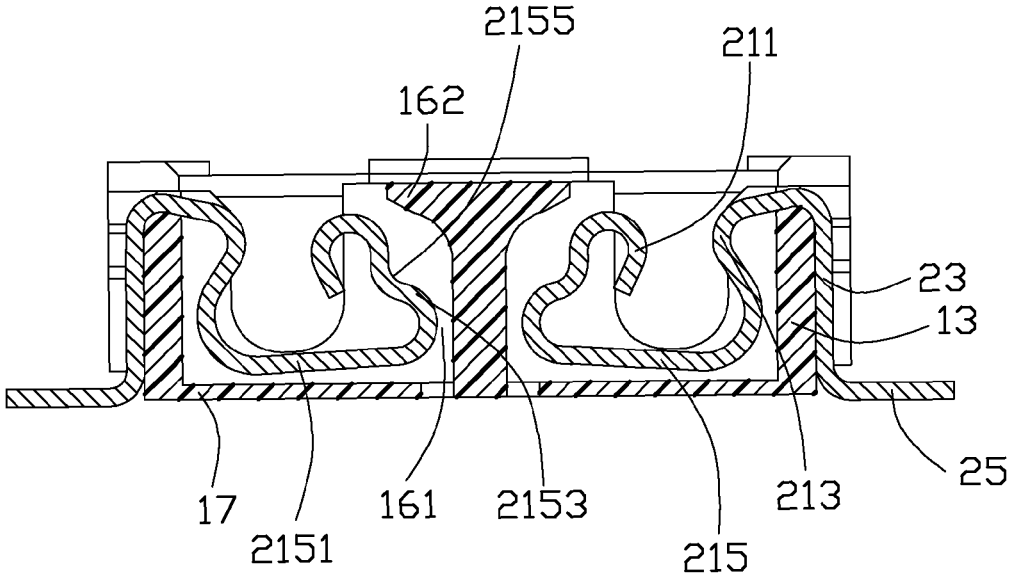
FIG. 4 is a cross sectional view of the electrical connector taken along line 4-4 in FIG. 1.

Referring to FIGS. 3-4, each contact 2 defines an elastic portion 21, a soldering portion 25, and a fixing portion 23 between the elastic portion 21 and the soldering portion 25 with barbs 231 on lateral sides thereof. The elastic portion 21 includes a first contacting portion 211 at a free distal end thereof, a second contacting portion 213 connected with the fixing portion 23, and a connecting portion 215 between and jointing with the first contacting portion 211 and the second contacting portion 213. The first contacting portion 211 and the second contacting portion 213 are symmetrically arranged along an imaginary line and contacting with two opposite sides of contacts of a mating electrical connector. The connecting portion 215 includes a first section 2151 substantially parallel extending from the second contacting portion 213 and a second section 2153 of an arc shaped connecting with the first section 2151 and the first contacting portion 211, which bends upwards. The first contacting portion 211 and the second section 2153 of the connecting portion 215 are configured with a reverse 3-shaped manner, i.e. a node 2155 of the second section 2153 deviates from an upright inside face of the receiving passageway 161. The housing 1 further defines a nose portion 162 extending from the mating portion 16 toward the sidewall and above the receiving passageway 161. The opening of the receiving room 15 is narrowed by the nose portion 162 extending toward the sidewall. The node 2155 is located away from the nose portion 162 to form a concavity so as to ensure a smooth insertion of the contact and avoid collision to the nose portion 162 when the contact is assembled into the housing 1 in a tilted and further rotated manner. The second section 2153 of the connecting portion 215 is just under the nose portion 162 and the first contacting portion 211 protrudes from the nose portion 162 into a receiving room to connect with the contact of the mating electrical connector. The fixing portion 23 and the second contacting portion 213 are configured with a reversed U-shaped manner.

Figure 5:
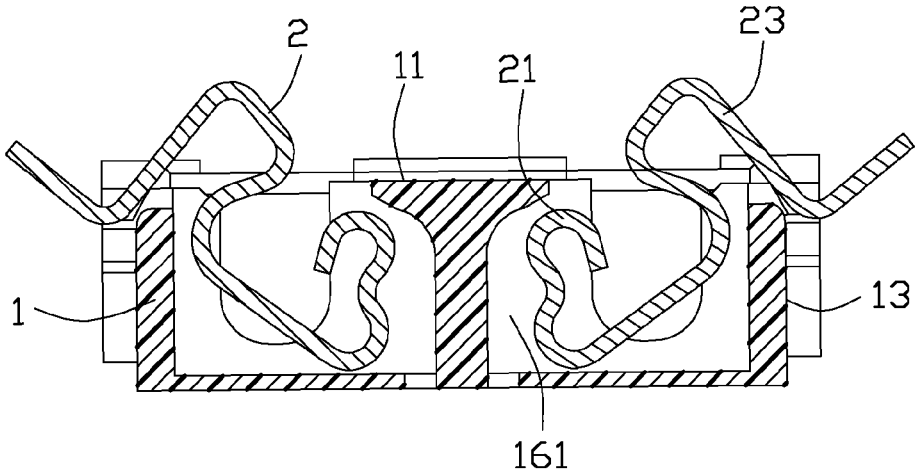
FIG. 5 is a cross sectional view showing an insertion process of contacts into an insulative housing.
Figure 5:
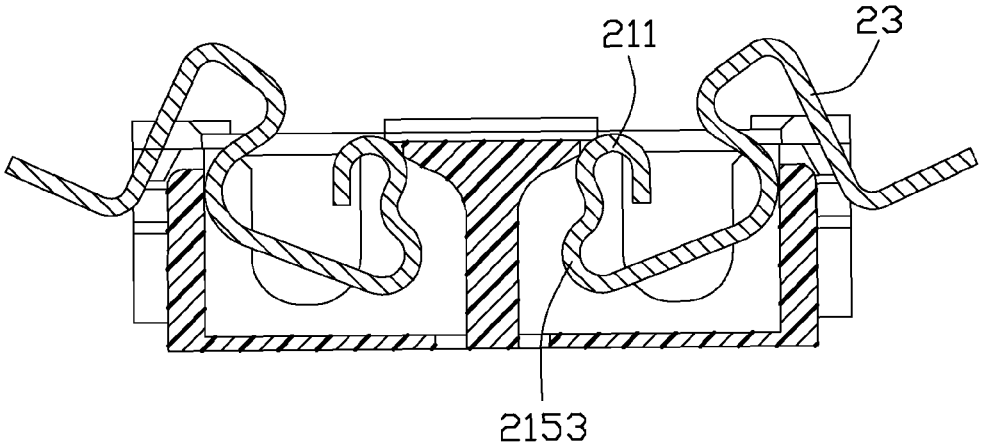
Figure 5:
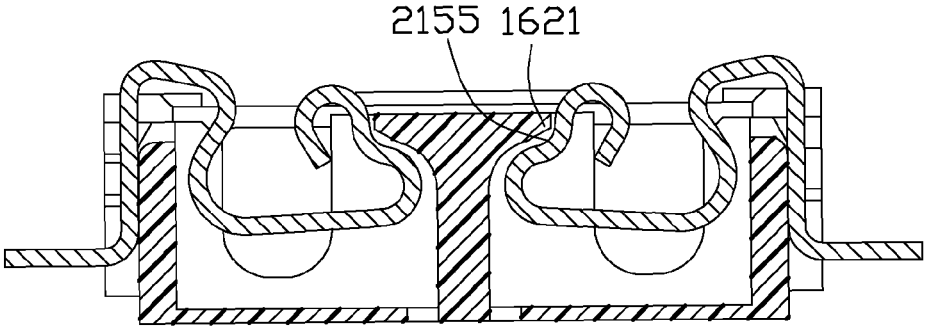

Referring to FIG. 5 showing an insertion process of the contacts 2 in the housing 1, the elastic portions 21 of the contacts 2 are slantingly inserted in the receiving passageway 161 from the mating face 11 and the fixing portions 23 are located above the lengthwise wall 13. Then, the fixing portions 23 are pushed downward and the first contacting portions 211 and the second sections 2153 shift upward as a result of levers work of the contacts 2 until the nodes 2155 abut against distal ends 1621 of the nose portions 162. At that time the contacts 2 are in a substantial level location and lastly are pushed downwards so that the fixing portions 23 interfere with the retaining passageways 131 and the first contacting portions 21 and the connecting portions 215 are located in the receiving room 15 as shown in FIG. 4.

The soldering portion 25 extends from the fixing portion 23 and close to the lengthwise sidewall 13. When the soldering portion 25 is welded to the PCB, the soldering portion 25 is coated with a protective solute for soldering. Most of the bottom wall 17 close to the lengthwise sidewalls 13 is closed so as to prevent the protective solute from inserting into the housing 1.

When the electrical connector 100 is separated from the mating electrical connector, the contacts 2 are moved upward due to a retaining force between the contacts 2 and the contacts of the mating electrical connector. After the contacts 2 have been moved with a distance, the second section 213 is resisted on the nose portion 162 by the node 2155 to prevent the contacts 2 out of the housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector secured to a PCB, comprising:

an insulative housing having an elongate configuration with a mating interface and defining a plurality of receiving passageways across the housing and symmetrically arranged along a mating portion;

each receiving passageway defining a receiving room defined by a sidewall, a bottom wall and a portion of the mating portion, and having an opening narrowed by a nose portion extending from the mating portion toward the sidewall; and a plurality of contacts each received in the corresponding receiving passageways and including an elastic portion, a soldering portion and a fixing portion between the elastic portion and a soldering portion, the elastic portion including a first contacting portion protruding from the nose portion, a second contacting portion extending from the fixing portion, and a connecting portion between said two contacting portions and defining an arc portion extending in an upward-to-downward direction and under the nose portion; wherein the arc portion defines a node avoiding collision to the nose portion when the contact is assembled into the contact receiving passageway in a tilted manner.

2. The electrical connector as claimed in claim 1, wherein the bottom wall adjacent to the soldering portion is substantially closed.

3. The electrical connector as claimed in claim 2, wherein the contacts are assembled in the housing slantly from the opening.

4. The electrical connector as claimed in claim 3, wherein the node is located away from the nose portion to form a concavity so as to ensure a smooth insertion of the contact.

5. The electrical connector as claimed in claim 4, wherein the fixing portion with barbs on lateral sides is retained in an outside face of the housing.

6. The electrical connector as claimed in claim 5, wherein the fixing portion and the second contacting portion are configured with a reversed U-shaped configuration.

7. The electrical connector as claimed in claim 5, wherein the first contacting portion and the second contacting portion are symmetrically arranged along an imaginary line.

8. An electrical connector comprising:

an insulative housing defining a plurality of passageways arranged in a lengthwise direction and extending in a transverse direction perpendicular to lengthwise direction, each passageway having a bottom wall and two upright walls, one upright wall defining a nose portion projecting from the said one upright wall toward another upright wall in the transverse direction adjacent to a mating face of the insulative housing;

a plurality of contacts each being configured to be assembled and secured into the corresponding passageway only by downward rotational movement of the contact with respect to the insulative housing.

9. The electrical connector as claimed in claim 8, wherein the rotational movement is centered on a retaining portion of the contact.

10. The electrical connector as claimed in claim 9, wherein the retaining portion of the contact is securely retained in said another upright wall.

11. An electrical connector comprising:

an insulative housing defining a plurality of passageways in one row along a longitudinal direction;

each of said passageways being defined between an inner side wall and an outer side wall in a transverse direction perpendicular to said longitudinal direction;

a plurality of nose portions each formed on an upper region of the corresponding inner side wall facing the corresponding passageway;

a plurality of retaining passageways each formed on a lower region of an exterior face of the corresponding outer side wall; and a plurality of contacts disposed in the corresponding passageways, respectively, each of said contacts including an inner contacting arm close to the inner side wall and an outer contacting arm close to while spaced from the outer side wall with a gap therebetween, said inner contacting arm and said outer contacting arm linked by a connecting portion which essentially extends along a lower half portion of the corresponding passageway, said connecting portion defining a node confronting the inner side wall and the corresponding nose portion for preventing upward withdrawal of the contact from the corresponding passageway, and a fixing portion extending outwardly in said transverse direction from the outer contacting section over the corresponding outer side wall with barbs thereon; wherein for each passageway, the outer side wall is lower than the inner side wall so as to allow the corresponding contact to be inserted into the corresponding passageway in a slanted manner with the inner contacting arm located under the nose portion and the fixing portion located over the outer side wall, and successively self-rotated to have the both the inner contacting arm and the outer contacting arm located above a top mating face of the housing, and finally downwardly lowered to have the fixing portion downwardly extending into the corresponding retaining passageway in a vertical direction perpendicular to both said longitudinal direction and said transverse direction to have the inner contacting arm and the outer contacting arm and the connecting portion of the whole contact at a final position in the corresponding passageway.

12. The electrical connector as claimed in claim 11, wherein in each of the contacts, the node is essentially compliant with a configuration of the nose portion and the corresponding inner side wall.

13. The electrical connector as claimed in claim 11, wherein the housing defines a bottom wall under each of said passageways to seal most portions of the corresponding passageway.

14. The electrical connector as claimed in claim 11, wherein each of said inner contacting arms defines a downward free end which is distanced from the corresponding inner side wall by the corresponding connecting portion.

15. The electrical connector as claimed in claim 13, wherein the bottom wall defines an opening below the corresponding nose portion.

16. The electrical connector as claimed in claim 11, wherein said barbs protrude and pierce into the outer side wall in the longitudinal direction.

* * * * *